US011348593B2

(12) United States Patent
Sushko et al.

(10) Patent No.: US 11,348,593 B2
(45) Date of Patent: May 31, 2022

(54) METHOD AND SYSTEM FOR ENCODING AND DECODING DATA IN AUDIO

(71) Applicant: Soundpays Inc., Toronto (CA)

(72) Inventors: Orest Sushko, Toronto (CA); Douglas Sutherland, Brampton (CA)

( * ) Notice: Subject to any disclaimer, the term of this patent is extended or adjusted under 35 U.S.C. 154(b) by 0 days.

(21) Appl. No.: 17/169,984

(22) Filed: Feb. 8, 2021

(65) Prior Publication Data

US 2021/0249021 A1 Aug. 12, 2021

Related U.S. Application Data

(60) Provisional application No. 62/970,885, filed on Feb. 6, 2020.

(51) Int. Cl.
*G10L 19/008* (2013.01)
*H04S 1/00* (2006.01)

(52) U.S. Cl.
CPC ..... *G10L 19/008* (2013.01); *H04S 1/002* (2013.01); *H04S 2400/15* (2013.01)

(58) Field of Classification Search
CPC ..... G10L 19/008
See application file for complete search history.

(56) References Cited

U.S. PATENT DOCUMENTS

2021/0035589 A1* 2/2021 Hicks ..... H04L 65/4069

* cited by examiner

*Primary Examiner* — Ping Lee
(74) *Attorney, Agent, or Firm* — Aird & McBurney LP

(57) ABSTRACT

A method and system for encoding data in audio are provided. A sequence of time deltas is generated at least partially based on a set of data. At least some of the time deltas are less than a threshold at which a human naturally detects an echo. A second audio channel is generated from a first audio channel, the second audio channel being temporally shifted relative to the first audio channel using the sequence of time deltas. The first and second audio channels are played back simultaneously via at least one audio transducer. The composite audio channel is registered via at least one microphone and processed to identify the first and second audio channels that are at least partially relatively temporally shifted. A sequence of time deltas by which the second audio channel is shifted temporally relative to the first audio channel is determined, and a set of data is decoded at least partially therefrom.

12 Claims, 8 Drawing Sheets

METHOD AND SYSTEM FOR ENCODING AND DECODING DATA IN AUDIO

CROSS-REFERENCE TO RELATED APPLICATIONS

This application claims the benefit of U.S. Provisional Application No. 62/970,885, filed Feb. 6, 2020, the contents of which are incorporated herein by reference in their entirety.

FIELD

The specification relates generally to data communications, and, in particular, to a method and system for encoding and decoding data in audio.

SUMMARY OF THE DISCLOSURE

In one aspect, there is provided a method for encoding data in audio, comprising: generating, via at least one processor, a sequence of time deltas at least partially based on a set of data to be encoded, at least some of the time deltas being less than a threshold at which a human naturally detects an echo; generating, from a first audio channel, a second audio channel that is at least partially temporally shifted relative to the first audio channel using the sequence of time deltas; and playing back the first audio channel and the second audio channel simultaneously via at least one audio transducer.

The first audio channel and the second audio channel can be generated from a source audio channel. One of the first audio channel and the second audio channel can be the source audio channel.

The time deltas can be generated at least partially based on the frequencies of at least one of the first audio channel and the second audio channel.

In another aspect, there is provided a method for decoding data in audio, comprising: registering a composite audio channel via at least one microphone; processing, via at least one processor, the composite audio channel to identify a first audio channel and a second audio channel that is at least partially temporally shifted relative to the first audio channel; determining a sequence of time deltas by which the second audio channel is at least partially shifted temporally relative to the first audio channel; and decoding a set of data at least partially from the sequence of time deltas.

The set of data can be decoded at least partially based on the frequencies of at least one of the first audio channel and the second audio channel.

In a further aspect, there is provided a system for encoding data in audio, comprising: at least one processor; at least one audio transducer operably connected to and controlled by the at least one processor; and a storage storing computer-executable instructions that, when executed by the at least one processor, cause the system to: generate a sequence of time deltas at least partially based on a set of data to be encoded, at least some of the time deltas being less than a threshold at which a human naturally detects an echo; generate, from a first audio channel, a second audio channel that is at least partially temporally shifted relative to the first audio channel using the sequence of time deltas; and play back the first audio channel and the second audio channel simultaneously via the at least one audio transducer.

The first audio channel and the second audio channel can be generated from a source audio channel. One of the first audio channel and the second audio channel can be the source audio channel.

The at least one processor can generate the time deltas at least partially based on the frequencies of at least one of the first audio channel and the second audio channel.

In yet another aspect, there is provided system for decoding data in audio, comprising: at least one processor; at least one microphone operably connected to the at least one processor; and a storage storing computer-executable instructions that, when executed by the at least one processor, cause the system to: register a composite audio channel via the at least one microphone; process the composite audio channel to identify a first audio channel and a second audio channel that is at least partially temporally shifted relative to the first audio channel; determine a sequence of time deltas by which the second audio channel is at least partially shifted temporally relative to the first audio channel; and decode a set of data at least partially from the sequence of time deltas.

The at least one processor can decode the set of data at least partially based on the frequencies of at least one of the first audio channel and the second audio channel.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings in which.

Figure 1:
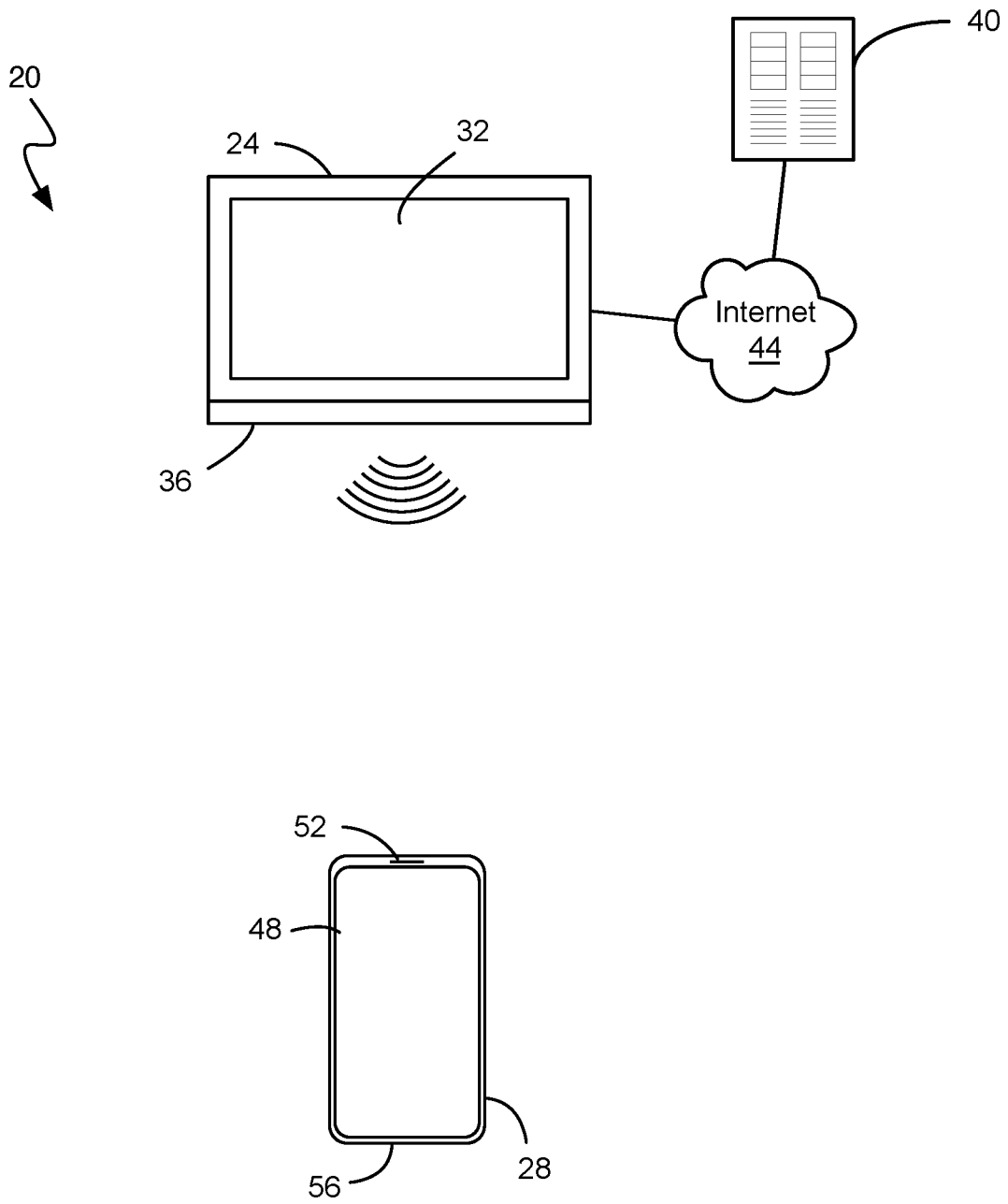
FIG. 1 shows a system for encoding and decoding data in audio in accordance with one embodiment thereof.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Any module, unit, component, server, computer, terminal, engine or device exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the device or accessible or connectable thereto. Further, unless the context clearly indicates otherwise, any processor or controller set out herein may be implemented as a singular processor or as a plurality of processors. The plurality of processors may be arrayed or distributed, and any processing function referred to herein may be carried out by one or by a plurality of processors, even though a single processor may be exemplified. Any method, application or module herein described may be implemented using computer readable/executable instructions that may be stored or otherwise held by such computer readable media and executed by the one or more processors.

A method and system for encoding and decoding data in audio is disclosed. In the method, some or all of a source audio channel is shifted by a sequence of time deltas so that some temporal segments of the audio channel are temporally shifted more than other temporal segments. In one embodiment, the time deltas are sufficiently small so that they are indistinguishable to a human when played back in comparison to the source audio channel.

A system 20 for encoding and decoding data in audio is shown in FIG. 1. The system 20 includes a first computing device in the form of a television set 24 and a second computing device in the form of a mobile device 28. The television set 24 has a display 32 and an audio transducer in the form of a loudspeaker 36. The loudspeaker 36 can be any type of suitable audio transducer for playback of an audio channel. The display 32 can be any type of display suitable for presenting images, such as an LED display, an LCD display, an OLED display, etc. The television set 24 is in communication with a server 40 via a data communications network or medium. In the illustrated embodiment, the data communications network or medium includes the Internet 44. In other embodiments, any other type of audio transducer can be employed to play back the audio channel.

The mobile device 28 is a smartphone or the like and includes a touchscreen display 48, an audio transducer in the form of a loudspeaker 52, and a microphone 56. The microphone can be any suitable microphone for registering audio.

In this illustrated embodiment, the television set 24 presents one or more images or videos of advertising or information. Simultaneously, an audio channel is played by the loudspeaker 36 of the television set 24. The audio channel carries data encoded in a manner as is described herein. The encoded data can be any set of data that is encodable in an audio channel using the provided approach, such as, for example, a URL for a website associated with the advertising or information, additional information about the advertised product or service, a reference identifier for the advertising or a URL at which the advertising is available, etc. Still other types of data that can be encoded using the described system will occur to those skilled in the art. In the illustrated embodiment, the encoded set of data is a reference identifier for a website having a URL associated with the advertised product or service. The reference identifier can be used to either locally or remotely look up the corresponding URL.

The mobile device 28 is sufficiently proximal to the television set 24 so that the microphone 56 of the mobile device 28 registers the audio channel played by the loudspeaker 36 of the television set 24. As the audio channel is being received by the mobile device 28 or thereafter, the mobile device 28 decodes the set of data within the audio channel. The set of data, once decoded, can then be acted upon, stored, or communicated to one or more other computing devices. Where the decoded set of data is a reference identifier, the mobile device 28 can either look up or request from a server the corresponding URL and act on it, causing the mobile device 28 to pass the URL to a default web browser on the mobile device 28 to thereby request the web page/resources identified by the URL. The decoded set of data can include a document, such as a PDF, an image, formatted or unformatted text, etc. Acting on the document can cause the mobile device 28 to pass the document to a default handler application for the received content.

The first computing device can be any suitable computing device for encoding a set of data in an audio channel and having or being connected, either locally or remotely, to one or more audio transducers for playing the audio channel. The second computing device can be any suitable computing device having one or more microphones for registering the audio channel and decoding the set of data in the audio channel and being configured to decode the set of data from the registered audio channel.

Figure 2:
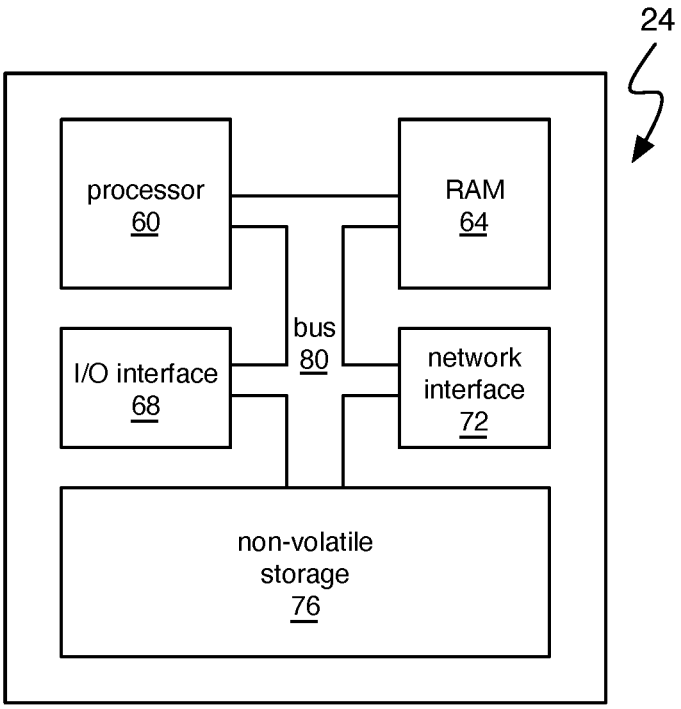
FIG. 2 is a schematic diagram showing various physical components of a first computing device for encoding data in audio in the system of FIG. 1.

FIG. 2 shows various physical elements of the television set 24. As shown, television set 24 has a number of physical and logical components, including a processor 60, random access memory ("RAM") 64, an input/output ("I/O") interface 68, a network interface 72, non-volatile storage 76, and a local bus 80 enabling the processor 60 to communicate with the other components. The processor 60 executes at least an operating system, and an application for encoding a set of data as described herein. The RAM 64 provides relatively responsive volatile storage to the processor 60. The I/O interface 68 allows for input to be received from one or more devices, such as the controls and I/R receiver of the television set 24, and outputs information to output devices, such as the display 32 and the loudspeaker 36. The network interface 72 permits communication with other computing devices over computer communication networks such as the Internet 44. Non-volatile storage 76 stores the operating system and applications, including computer-executable instructions for implementing the data encoding. During operation of the television set 24, the operating system, the applications, and the set of data may be retrieved from non-volatile storage 76 and placed in RAM 64 to facilitate execution.

Figure 3:
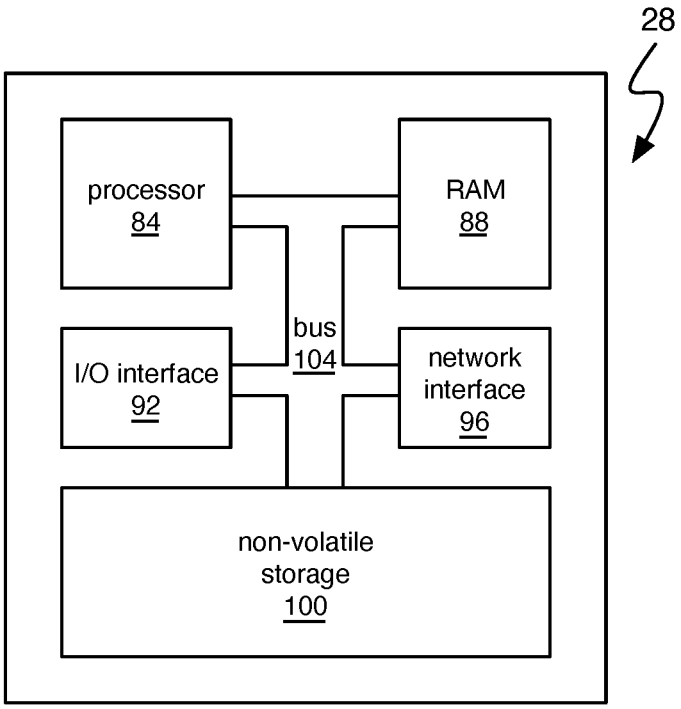
FIG. 3 is a schematic diagram showing various physical components of a second computing device for decoding data in audio in the system of FIG. 1.

FIG. 3 shows various physical elements of the mobile device 28. As shown, the mobile device 28 has a number of physical and logical components, including a processor 84, random access memory ("RAM") 88, an input/output ("I/O") interface 92, a network interface 96, non-volatile storage 100, and a local bus 104 enabling the processor 84 to communicate with the other components. The processor 84 executes at least an operating system, and an application for decoding data as described herein. The RAM 88 provides relatively responsive volatile storage to the processor 84. The I/O interface 92 allows for input to be received from one or more devices, such as the controls and touchscreen display 48 of the mobile device 28, and outputs information to output devices, such as the touchscreen display 48 and the loudspeaker 52. The network interface 96 permits communication with other computing devices over computer communication networks such as the Internet 44. Non-volatile storage 100 stores the operating system and applications, including computer-executable instructions for implementing the data encoding. During operation of the mobile device 28, the operating system, the applications, and the set of data may be retrieved from non-volatile storage 100 and placed in RAM 88 to facilitate execution.

Figure 4:
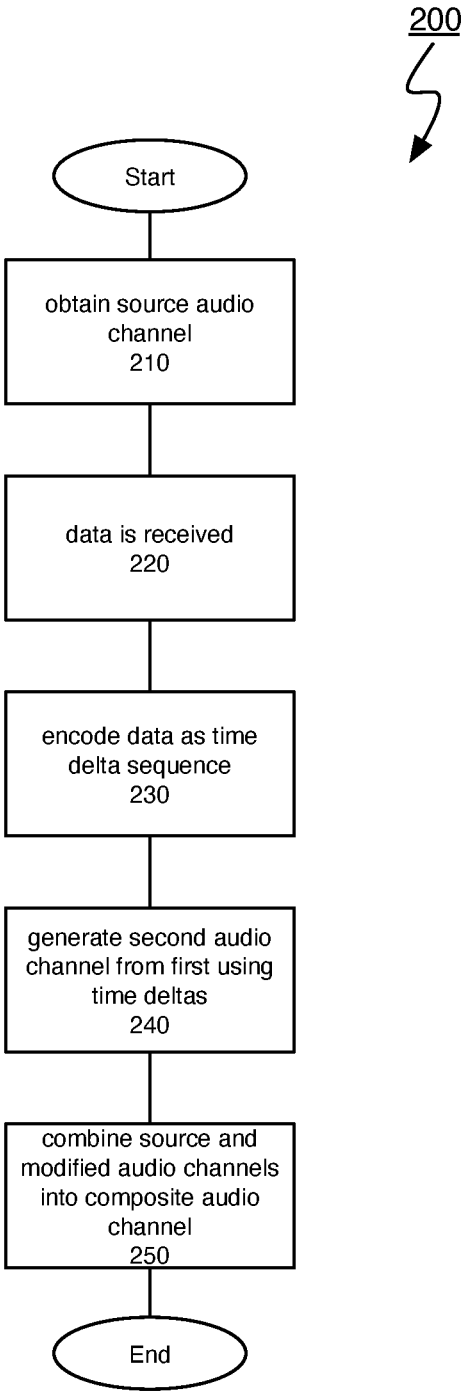
FIG. 4 is a flowchart of the general method of encoding data in audio via the computing device of FIG. 2.

The method 200 of encoding data in audio performed by the television set 24 will now be discussed with reference to FIGS. 1, 2, and 4. The method 200 commences with the obtaining of a source audio channel (210). As used herein, an audio channel is a temporal sequence of tones, noises, etc. The source audio channel can be received or stored in the storage of the television set 24 or can be streamed to the television set 24. In some configurations, the source audio channel can be a musical composition. In other configurations, the source audio channel can be a human monologue or dialogue, or any suitable audio channel. Other types of source audio channels will occur to those skilled in the art. A set of data to be encoded in the audio channel is then received (220).

Next, the set of data is encoded as a sequence of time deltas (230). The source audio channel is segmented into a sequence of segments in any suitable manner. For example, in one mode, the source audio channel is segmented into time segments of equal length. In another mode, the source audio channel can be segmented into time segments of varying length in accordance with a pre-defined segmenting scheme. Further, the segments can be selected based on identified temporal portions of the source audio channel in which time-delayed repeated audio sounds are likely to have a lower probability of detection as an echo by a human ear.

A function is applied to the set of data to generate a sequence of time deltas. The time deltas in the present embodiment are lower than a threshold value of about 50 milliseconds at which the human ear can distinguish echoes. This threshold value is referred to herein as the pre-echo threshold ("PET"). If a human ear hears a first instance of a sound and then a second instance of the sound repeated after a period of time that is smaller than the PET, the two instances of the sound are not distinguished by the human. If, instead, a first instance of a sound and then a second instance of the sound repeated after a period of time that is larger than the PET is received by a human ear, the two instances of the sound are distinguished by the human and the second instance is identifiable as an echo.

The PET can be frequency dependent. Thus, the segments of the audio channel can be selected at least partially based on the frequencies therein.

In various scenarios, some segments can be assigned time deltas of zero milliseconds, and the length of these segments can be selected so as to position other segments having non-zero time deltas according to identified temporal regions of the audio channel that are more suitable for injecting repeated audio sounds, for example, so that they are less detectable by a human ear.

The sequence of time deltas is then used to generate a second audio channel from a first audio channel (240). In this embodiment, the source audio channel is used as the first audio channel and a second audio channel is generated from the source audio channel. Each sequential segment of the source audio generated at 230 is shifted by a next time delta in the sequence.

Figure 5:
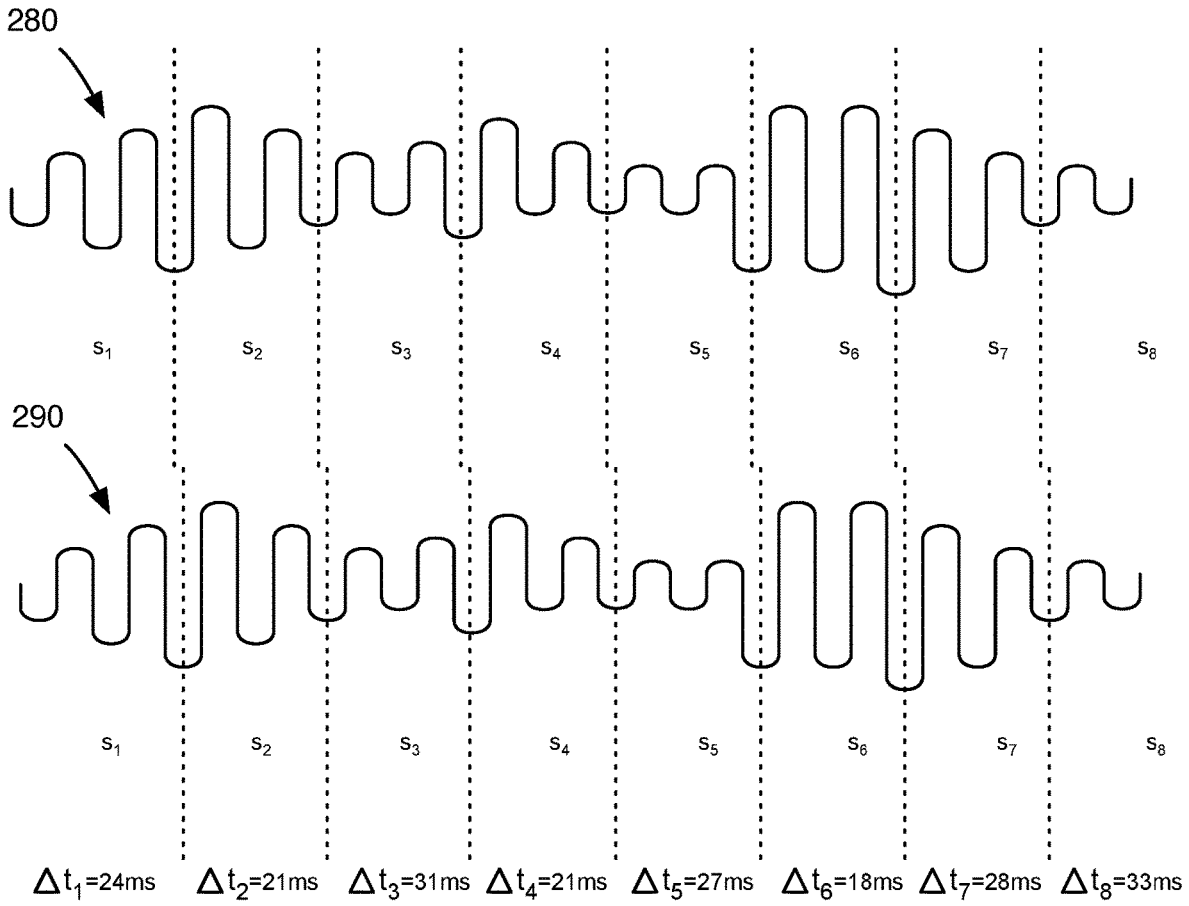
FIG. 5 shows a portion of a source audio channel next to a portion of a modified audio channel based on the source audio channel, the segments of which have been temporally shifted using a sequence of time deltas.

FIG. 5 shows a portion of a source audio channel 280 being divided into a set of eight segments, $s_1$ to $s_8$, of equal length. For purposes of illustration, the source audio channel 280 has been illustrated as a waveform which has been segmented into very short segments, but it will be understood that more complex audio channels and differently selected segments can be represented by this example.

Also shown is a modified audio channel 290 generated using the source audio channel 280 after each segment thereof has been temporally shifted. In this illustrated example, the set of data has been encoded into a sequence of time deltas from $\Delta t1$=24 milliseconds to $\Delta t8$=33 milliseconds. These time deltas are then used to shift forward the segments s1 to s8 of the source audio channel 280 to generate the modified audio channel 290.

In another embodiment, two separate audio channels can be generated from the source audio channel. An initial time delta sequence can be applied to the source audio channel to shift each segment thereof to generate a first modified audio channel. This initial time delta sequence may be derived from the time delta sequence generated at 230 or may be determined independently. A second modified audio channel can be generated from the source audio channel by shifting each segment thereof so that the segment is offset temporally relative to the corresponding segment of the first modified audio channel by the time delta for that segment determined at 230.

In scenarios in which one or more of the time deltas are zero, it can be said that the second audio channel is at least partially temporally shifted relative to the first audio channel. In other scenarios, the second audio channel can be fully time shifted relative to the first audio channel.

Transitions between segments s1 to s8 can be provided in a variety of ways. In one example, where the time shift of a first of a pair of adjacent segments is greater than the time shift of a second of a pair of adjacent segments, the end of the first of the pair of adjacent segments can be shortened or otherwise compressed, and where the time shift of a first of a pair of adjacent segments is lesser than the time shift of a second of a pair of adjacent segments, the end of the first of the pair of adjacent segments can be extended or otherwise lengthened, such as by maintaining the frequencies at the end of the first segment, or a gap can be inserted between the first and second segments.

Returning again to FIG. 4, once the modified audio channel is generated, the source audio channel and the modified audio channel are then combined into a single composite audio channel (250). The source and modified audio channel can be combined by muxing the two audio channels together.

Referring again to FIG. 5, in this illustrated example, the source audio channel 280 is then muxed together with the modified audio channel 290 to generate a composite audio channel.

It will be appreciated that the composite audio channel can be generated on the fly where the source audio channel is streamed to the television set 24.

Once the composite audio channel is generated, or as it is being generated, it is played via the loudspeaker 36 of the television set 24.

The mobile device 28 is sufficiently close to the television set 24 to receive and register the played composite audio channel via its microphone 56 and begins the process of decoding the set of data from the audio.

Figure 6:
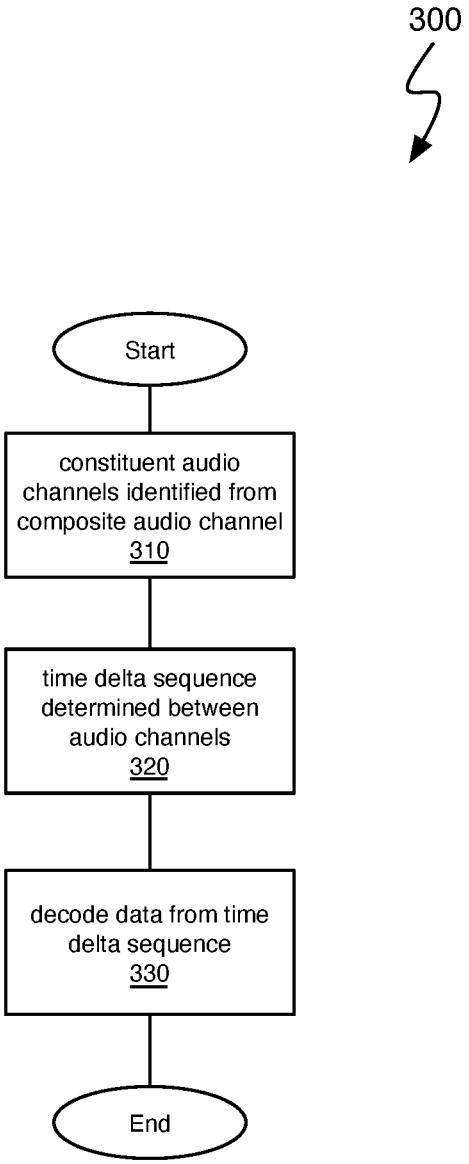
FIG. 6 is a flowchart of the general method of decoding data in audio via the computing device of FIG. 3.

FIG. 6 shows the method 300 of decoding the data from the composite audio channel. Upon commencing to register the composite audio channel with the microphone 56, the mobile device 28 analyzes the composite audio channel to identify a first audio channel and a second audio channel that is temporally shifted relative to the first audio channel (310). This can be done via Fast Fourier Transform ("FFT") or any other suitable method by looking for two similar temporally adjacent waveform components. Once the first and second audio channels are identified, the time deltas sequence between the first and second audio channels is determined (320). Time deltas are determined between the two audio channels at a period that is significantly shorter than the length of the time segments so that the time delta for each segment can be discovered and verified. For example, if the segments are one second long, the time deltas between the two audio channels can be determined at each quarter second so that four consecutive calculated time deltas will generally be equal. Once the time delta sequence has been determined, the time delta sequence is transformed to reconstitute the set of data that was originally encoded by the television set 24 (330).

Upon decoding the set of data, action can then be taken on the decoded set of data. The action taken can depend on the type of data that is decoded. For example, where the decoded set of data is a URL, the action can be to send a call to a web browser application on the mobile device 28 to retrieve and display the webpage at that address. Other types of actions for different data types will occur to those skilled in the art.

It will be appreciated that the system encoding the data in the audio can be remote from the audio transducer upon which the resulting composite audio channel is played. For example, the television set may receive the composite audio channel together with the images to be presented on the display from another computing device such as a local or remote server.

It can be desirable to determine the time delays in the sequence at least partially based on the frequencies of the segments of the source audio channel.

Figure 7:
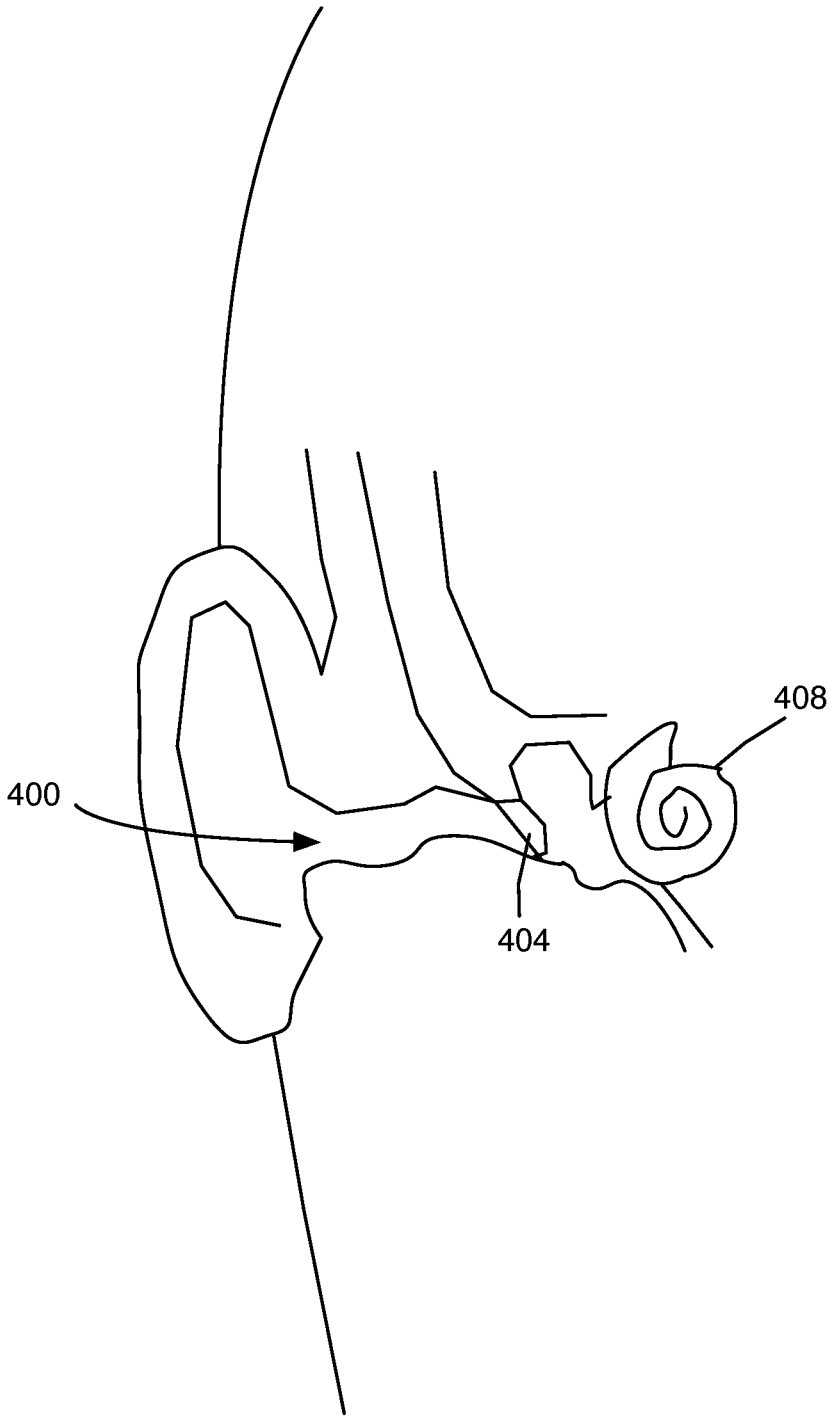
FIG. 7 shows a section view of a human head showing the ear canal and the cochlea.

FIG. 7 shows an ear canal 400 of a human. The ear canal 400 extends to tympanic membrane 404 commonly referred to as an ear drum that transmits vibrations to ossicles. The ossicles, in turn, transmit vibrations from the ear drum to the oval window of the inner ear in which is positioned the cochlea 408. The cochlea is a spiralled, hollow, conical chamber of bone, in which waves propagate from the base (near the middle ear and the oval window) to the apex (the top or center of the spiral). Cilia along the entire length of the cochlear coil detect vibrations. In particular, the cilia towards the outer portion of the cochlea sense higher frequencies and the cilia towards the inner portion of the cochlea sense lower frequencies.

Figure 8:
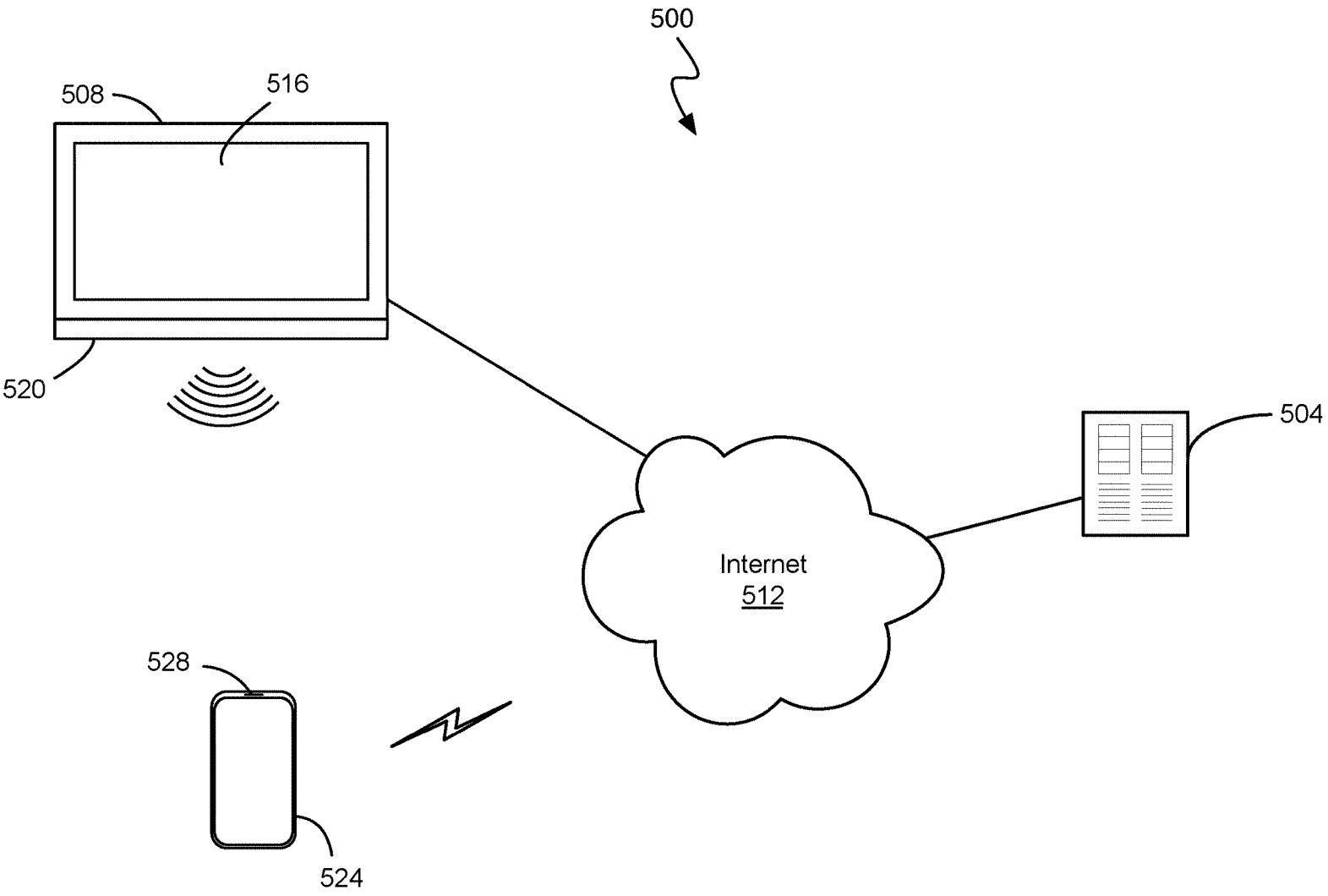
FIG. 8 shows a system for encoding and decoding data in audio in accordance with another embodiment.

FIG. 8 shows a system 500 for encoding and decoding data in audio in accordance with another embodiment. In this embodiment, a server 504 generates a sequence of time deltas to encode a set of data in audio. The sequence of time deltas is used to shift segments of the audio channel relative to a reference segment, such as an initial segment of the audio channel, to generate a modified audio channel. The modified audio channel is then communicated, along with one or more advertising images or videos, to a computing device such as a television set 508 via a data communications network, such as the Internet 512. Alternatively, the television set 508 can generate the modified audio channel from the source audio channel. The television set 508 then displays the images and/or video on a display 516, and plays the received modified audio channel via an audio transducer in the form of a loudspeaker 520.

Another computing device, such as a mobile device 524, is positioned sufficiently close to the loudspeaker 520 to register the played modified audio channel via a microphone 528 thereof. The mobile device 524 then uses the reference time segment of the modified audio channel to align it to the source audio channel so that the time deltas of the segments of the modified audio channel can be determined using an approach similar to the one described above. Once the time deltas have been determined, the set of data is decoded from the time deltas by transforming the time deltas such as by using a pre-determined transformation function. The decoded set of data can then be acted on to trigger the presentation of a webpage, etc. In a further alternative embodiment, the mobile device 524 can communicate the received modified audio channel to a remote computing device, such as the server 504, for decoding of the set of data and returning the decoded set of data to the mobile device 524.

Figure 9:
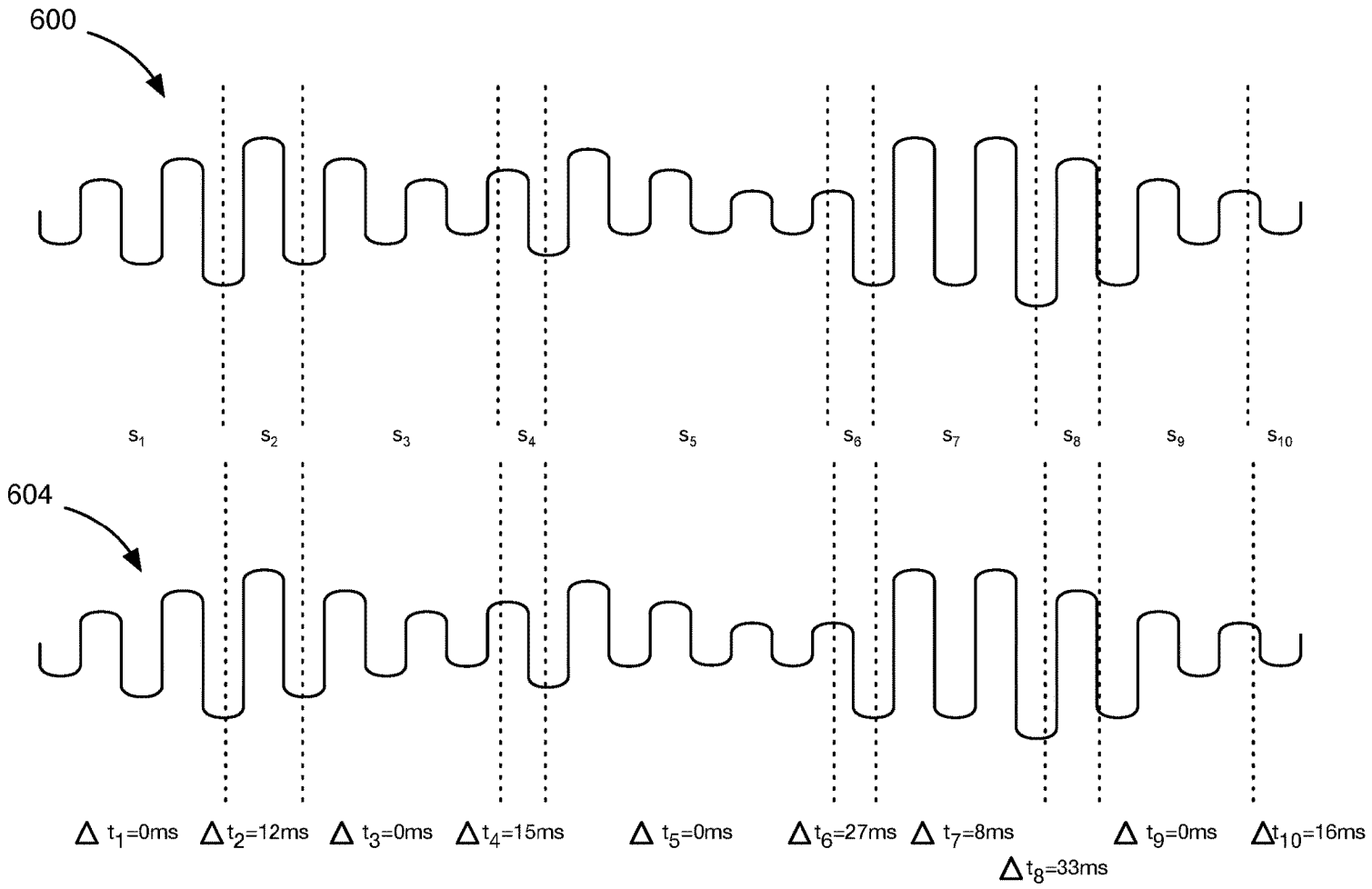
FIG. 9 shows a portion of a source audio channel next to a portion of a modified audio channel based on the source audio channel that has segments temporally shifted relative to the source audio channel.

FIG. 9 shows a portion of a source audio channel 600 being divided into a set of ten segments, $s_1$ to $s_{10}$, of equal length. For purposes of illustration, the source audio channel 600 has been illustrated as a waveform which has been segmented into very short segments, but it will be understood that more complex audio channels and differently selected segments can be represented by this example.

Also shown is a modified audio channel 604 generated using the source audio channel 600 after some segments thereof have been temporally shifted. In particular, segments s2, s4, s6 to s8, and s10 have been temporally shifted relative to their counterpart segments in the source audio channel 600. Segments s2, s4, s6 to s8, and s10 have been shifted by time deltas of 12 milliseconds, 15 milliseconds, 27 milliseconds, 8 milliseconds, 33 milliseconds, and 16 milliseconds respectively. The transitions between the segments can be handled in a variety of manners, as noted previously.

The lengths of the time-shifted segments can be selected to be a variety of lengths. Preferably, the lengths of the time-shifted segments are sufficiently short so as to reduce the amount of the first audio channel that is distorted. In one embodiment, the time segments can be between 1 and 500 milliseconds. The segment length can be selected dependent on the spectral nature of the signal being encoded.

In another embodiment, the presence of certain characteristics according to which the source audio channel is segmented can be used to identify the segments to thereby extract the data based on the time deltas at determined locations in the audio channel.

The time deltas can be generated in any manner based on the set of data. In one configuration, the time deltas can form an alphabet.

While, in some of the above-described embodiments, two audio channels are muxed to generate a single audio channel, in other embodiments, the two audio channels can be maintained separate and played separately through separate audio transducers.

While, in the above-described embodiments, each segment of the audio channels is time shifted using a relatively constant time delta, in other embodiments, functions can be employed to generate a time shift delta function for a single segment. In these scenarios, multiple time deltas representing a continuum or near continuum may be used to time shift each segment.

It is contemplated that more than two audio channels with segments that are temporally shifted relative to one another can be generated and played simultaneously to encode data.

Computer-executable instructions for implementing the encoding and/or decoding of data in audio on a computer system could be provided separately from a computing device, for example, on a computer-readable medium (such as, for example, an optical disk, a hard disk, a USB drive or a media card) or by making them available for downloading over a data communications network, such as the Internet.

While the computing devices are shown as single physical computing devices, it will be appreciated that the computer devices can include two or more physical computing devices in communication with each other.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A method for encoding data in audio, comprising:

generating, via at least one processor, a sequence of time deltas at least partially based on a set of data to be encoded, at least some of the time deltas being less than a threshold at which a human naturally detects an echo;

generating, from a first audio channel, a second audio channel that is at least partially temporally shifted relative to the first audio channel using the sequence of time deltas; and playing back the first audio channel and the second audio channel simultaneously via at least one audio transducer.

2. The method of claim 1, wherein the first audio channel and the second audio channel are generated from a source audio channel.

3. The method of claim 2, wherein one of the first audio channel and the second audio channel is the source audio channel.

4. The method of claim 1, wherein, during the generating the sequence of time deltas, the time deltas are generated at least partially based on the frequencies of at least one of the first audio channel and the second audio channel.

5. A method for decoding data in audio, comprising:

registering a composite audio channel via at least one microphone;

processing, via at least one processor, the composite audio channel to identify a first audio channel and a second audio channel that is at least partially temporally shifted relative to the first audio channel;

determining a sequence of time deltas by which the second audio channel is at least partially shifted temporally relative to the first audio channel; and decoding a set of data at least partially from the sequence of time deltas.

6. The method of claim 5, wherein, during the decoding, the set of data is decoded at least partially based on the frequencies of at least one of the first audio channel and the second audio channel.

7. A system for encoding data in audio, comprising:

at least one processor;

at least one audio transducer operably connected to and controlled by the at least one processor; and a storage storing computer-executable instructions that, when executed by the at least one processor, cause the system to:

generate a sequence of time deltas at least partially based on a set of data to be encoded, at least some of the time deltas being less than a threshold at which a human naturally detects an echo;

generate, from a first audio channel, a second audio channel that is at least partially temporally shifted relative to the first audio channel using the sequence of time deltas; and play back the first audio channel and the second audio channel simultaneously via the at least one audio transducer.

8. The system of claim 7, wherein the first audio channel and the second audio channel are generated from a source audio channel.

9. The system of claim 8, wherein one of the first audio channel and the second audio channel is the source audio channel.

10. The system of claim 7, wherein the at least one processor generates the time deltas at least partially based on the frequencies of at least one of the first audio channel and the second audio channel.

11. A system for decoding data in audio, comprising:

at least one processor;

at least one microphone operably connected to the at least one processor; and a storage storing computer-executable instructions that, when executed by the at least one processor, cause the system to:

register a composite audio channel via the at least one microphone;

process the composite audio channel to identify a first audio channel and a second audio channel that is at least partially temporally shifted relative to the first audio channel;

determine a sequence of time deltas by which the second audio channel is at least partially shifted temporally relative to the first audio channel; and decode a set of data at least partially from the sequence of time deltas.

12. The system of claim 11, wherein the at least one processor decodes the set of data at least partially based on the frequencies of at least one of the first audio channel and the second audio channel.

* * * * *